US011802446B2

(12) United States Patent
Meijer

(10) Patent No.: US 11,802,446 B2
(45) Date of Patent: Oct. 31, 2023

(54) SWIVEL FOR SUBSEA STRING

(71) Applicant: ONESUBSEA IP UK LIMITED, London (GB)

(72) Inventor: John Meijer, Sugar Land, TX (US)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 17/596,675

(22) PCT Filed: Jun. 23, 2020

(86) PCT No.: PCT/US2020/039174
§ 371 (c)(1),
(2) Date: Dec. 16, 2021

(87) PCT Pub. No.: WO2020/263853
PCT Pub. Date: Dec. 30, 2020

(65) Prior Publication Data

US 2022/0341269 A1 Oct. 27, 2022

Related U.S. Application Data

(60) Provisional application No. 62/866,009, filed on Jun. 25, 2019, provisional application No. 62/866,016, filed on Jun. 25, 2019, provisional application No. 62/865,389, filed on Jun. 24, 2019.

(51) Int. Cl.
*E21B 17/05* (2006.01)
*E21B 17/01* (2006.01)

(52) U.S. Cl.
CPC ..... *E21B 17/05* (2013.01); *E21B 17/01* (2013.01)

(58) Field of Classification Search
CPC ..... E21B 17/01; E21B 17/05
See application file for complete search history.

(56) References Cited

U.S. PATENT DOCUMENTS

| | | | | |
|---|---|---|---|---|
| 8,127,854 | B2 * | 3/2012 | Haheim | E21B 33/068 166/344 |
| 10,697,262 | B2 * | 6/2020 | Gosney | E21B 21/106 |
| 11,319,758 | B2 * | 5/2022 | Meijer | F16F 1/32 |
| 2006/0060360 | A1 | 3/2006 | Moncus et al. | |
| 2011/0214871 | A1 | 9/2011 | Leduc et al. | |
| 2014/0332230 | A1 | 11/2014 | Robichaux et al. | |
| 2016/0305213 | A1 | 10/2016 | Godfrey et al. | |

(Continued)

OTHER PUBLICATIONS

International Search Report and Written Opinion issued in PCT Application PCT/US2020/039174, dated Sep. 28, 2020 (14 pages).

(Continued)

*Primary Examiner* — Aaron L Lembo
(74) *Attorney, Agent, or Firm* — Eileen Pape

(57) ABSTRACT

An improved swivel with increased sealing capability at fluid pressures up to 20 ksi and at fluid temperatures as high as 250° F. and as low as 35° F. The swivel may be relatively compact, being less than 8 feet in overall length and can operate unpressurized with axial loads of at high as 1,400,000 lbs. The swivel may comprise a swivel mandrel rotationally coupled with a swivel housing. Rotational bearings units can be securely held using cartridge carriers. A pressure seal may be formed between the swivel mandrel and swivel housing via a redundant seal stack.

20 Claims, 6 Drawing Sheets

(56) References Cited

U.S. PATENT DOCUMENTS

| | | | | |
|---|---|---|---|---|
| 2016/0319087 | A1* | 11/2016 | Niihara | C08L 9/04 |
| 2017/0037841 | A1 | 2/2017 | Robison et al. | |
| 2018/0355975 | A1* | 12/2018 | Petrou | F16L 37/22 |

OTHER PUBLICATIONS

International Preliminary Report on Patentability of PCT Application PCT/US2020/039174 dated Jan. 6, 2022, 11 pages.

* cited by examiner

SWIVEL FOR SUBSEA STRING

REFERENCE TO RELATED APPLICATIONS

This patent application claims the benefit of and incorporates by reference each of the following provisional applications: U.S. Provisional Pat. Appl. No. 62/865,389 filed Jun. 24, 2019; U.S. Provisional Pat. Appl. No. 62/866,009 filed Jun. 25, 2019; and U.S. Provisional Pat. Appl. No. 62/866,016 filed Jun. 25, 2019.

BACKGROUND

In subsea operations, hydrocarbon fluids such as oil and natural gas are obtained from a subterranean geologic formation, referred to as a reservoir, by drilling a well that penetrates the hydrocarbon-bearing geologic formation. In various subsea applications, swivels are deployed along subsea landing strings to enable rotational motion of one system or component with respect to another. A swivel having components which rotate with respect to each other and provide a dynamic pressure seal often can be referred to as a dynamic swivel. The dynamic seal can be formed using O-rings or mechanical spring energized (MSE) seals. Such seals are able to hold axial and radial pressures. However, operating a swivel at relatively high pressures and under high axial loads can be challenging. Also, conventional bearing retention methods such as retaining rings/snap rings can be insufficient with respect to holding against axial, rotational, and bending forces. Known arrangements of components can also result in a dynamic swivel having substantial axial length. Furthermore, operating at high and low temperatures can also provide challenges for swivels, since the sealing mechanisms can be damaged and prone to leakage.

SUMMARY

According to some embodiments, a swivel is described that is configured for mounting along a tool string being deployed in an offshore environment. The swivel includes: a swivel mandrel having a first mechanical connector and a central bore through which pressurized well fluids are configured to pass; a swivel housing partially surrounding the swivel mandrel and including a second mechanical connector; first and second rotation bearing units together allowing for relative rotation about the central longitudinal axis, between the swivel mandrel and the swivel housing, thereby providing for relative rotation between one or more structures mounted to the first connector and one or more structures mounted to the second connector; first and second rotation bearing carriers configured to secure and retain the first and second rotation bearing units, respectively; a thrust bearing unit configured to allow for relative rotation between the swivel mandrel, the thrust bearing primarily supporting axial loads between the mandrel and housing in directions parallel to the longitudinal axis; and a rotating and pressure containing dynamic sealing system, the sealing system configured to contain pressurized well fluids flowing through the central bore.

According to some embodiments, the test string can include a subsea landing string configured for deployment through a subsea riser structure. The swivel can be configured to be vertically mounted with the first connection being made to the flowhead above the swivel, and the second connection being made to a master valve below the swivel.

The first and second rotation bearing units can each include a plurality of cylindrical rolling bearing elements.

According to some embodiments, the improved design allows for a swivel being compact, with an overall length of less than 8 feet. The swivel can operate with the axial loads up to at least 1,200,000 pounds while the central bore is not pressurized. The dynamic sealing system can be configured to contain pressurized well fluids up to pressures of at least 18,000 psi.

According to some embodiments, each of the first and second bearing carriers have inner surfaces that are configured to securely engage the outer surfaces of the first and second rotation bearing units, respectively, and each of the carriers are mounted in a fixed relationship with respect to the swivel housing. Each of the first and second rotation bearing units can also have inner surfaces configured to engage outer surfaces on the swivel spindle.

According to some embodiments, the dynamic sealing system comprises a primary seal and a secondary seal. Each of the primary and secondary seals can include a plurality of elastomeric sealing elements having chevron-shaped cross-sections. The dynamic sealing system can be configured to contain well fluids as low as 35° F. and as high as 250° F.

As used herein, the term dynamic swivel is a swivel that includes one or more dynamic seals.

According to some embodiments, a swivel is described that is configured for mounting along a tool string being deployed in an offshore environment. The swivel includes: a swivel mandrel including a first mechanical connector and a central longitudinal bore through which pressurized well fluids are configured to pass; a swivel housing partially surrounding the swivel mandrel and including a second mechanical connector; first and second rotation bearing units together allowing for relative rotation about a central longitudinal axis, between the swivel mandrel and the swivel housing, thereby providing for relative rotation between one or more structures mounted to the first connector and one or more structures mounted to the second connector; a thrust bearing unit configured to allow for relative rotation between the swivel mandrel, the thrust bearing primarily supporting axial loads between the mandrel and housing in directions parallel to the longitudinal axis; and a rotating and pressure containing dynamic sealing system. The sealing system being configured to contain pressurized well fluids flowing through the central bore, the sealing system comprising a primary seal and a secondary seal, each of the primary seal and the secondary seal having a plurality of elastomeric sealing elements having chevron-shaped cross-sections.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

According to some embodiments, systems and methodologies are described for a compact dynamic swivel able to operate at high pressures and loading as well as at extreme temperatures. The compact swivel may comprise a swivel mandrel rotationally coupled with a swivel housing. A dynamic pressure seal may be formed between the swivel mandrel and swivel housing. Additionally, the rotational motion of the swivel mandrel relative to the swivel housing about the main longitudinal axis of the swivel is accommodated by rotational bearings, e.g. cylindrical roller bearings. Further, thrust loads between components are countered by a thrust bearing. According to some embodiments, a compact swivel is described that incorporates bearing structures which enable placement of the rotational bearings and the thrust bearing in close proximity to each other. The bearing arrangement enables construction of an axially compact swivel mandrel.

According to some embodiments, the swivel includes an improved rotational bearing configuration. The swivel incorporates rotational bearings, e.g. an upper rotational bearing unit and a lower rotational bearing unit. The bearing units are positioned in self-contained bearing cartridges that provide improved structural integrity to protect the bearings against axial, rotational, and bending forces. The cartridge design also allows for easy assembly of the various mechanical components while maintaining compact axial length as well as tolerance to high pressures and loads.

According to some embodiments, an improved swivel is described that includes high-level sealing capability even during rotational cycling at high temperatures, e.g. 250° F. and above, and low temperatures, e.g. 35° F. and below. A dynamic pressure seal may be formed between the swivel mandrel and swivel housing via a redundant seal stack. The redundant seal stack comprises redundant seals having a chevron-shaped cross section that are arranged to provide and maintain sealing even during rotational cycling at high and low temperatures.

Figure 1:
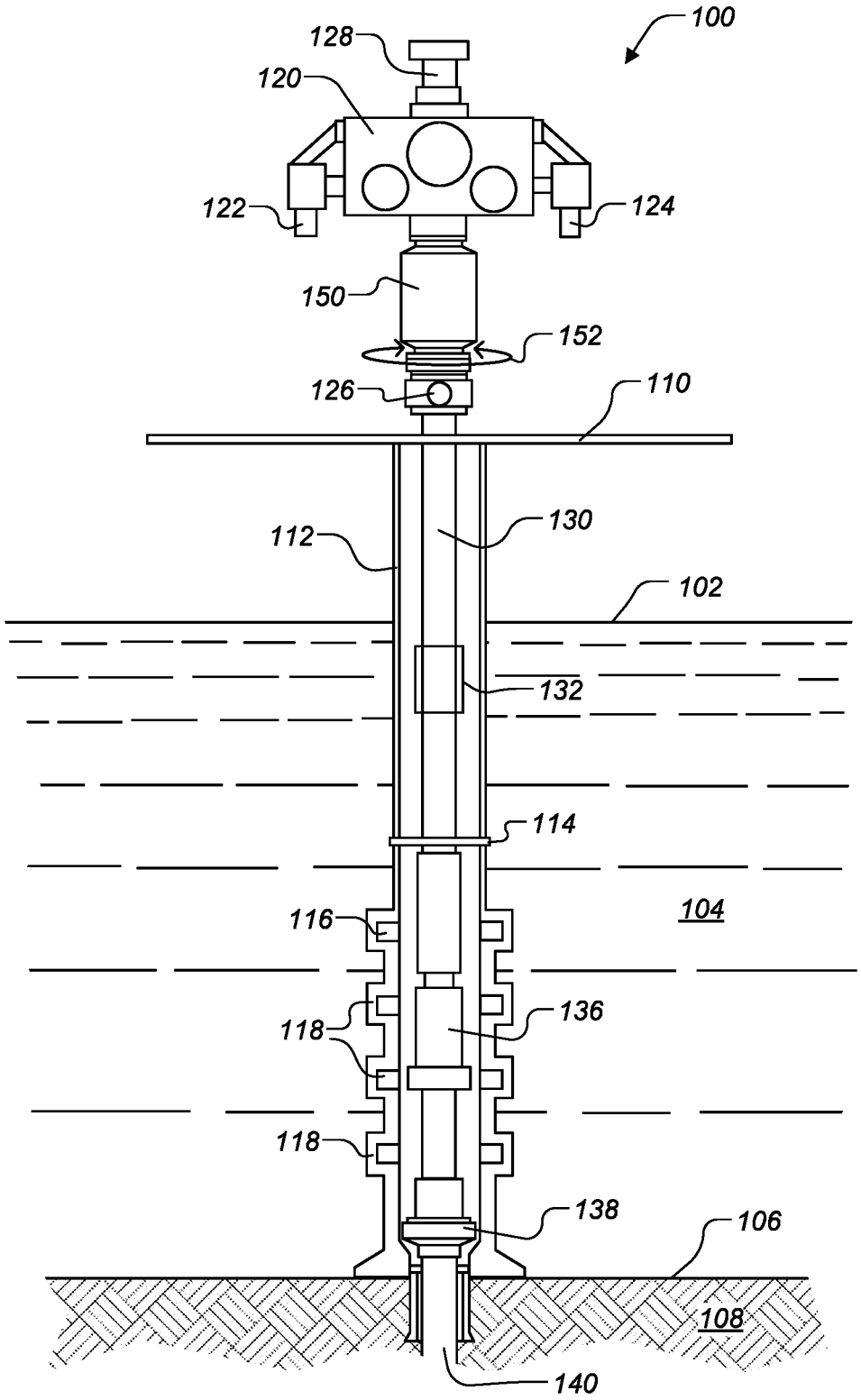
FIG. 1 is a schematic diagram illustrating a subsea landing string configuration in which an improved swivel can be utilized, according to some embodiments.

FIG. 1 is a schematic diagram illustrating a subsea landing string configuration in which an improved swivel can be utilized, according to some embodiments. System 100 is shown being deployed in an offshore environment. The system 100 includes a flowhead 120 that supports the test string 130, and provides a means of surface well control when completing, testing, and/or performing live well intervention operations. The flow head 120 is being deployed above rig floor 110 from an offshore oilfield rig such as semisubmersible vessel. According to some embodiments, the offshore rig can be some other type of mobile offshore drilling unit such as a jackup or submersible, other suitable vessel, platform or structure. According to some embodiments, the test string 130 is deployed from a platform or vessel that is not configured for drilling, such as from a floating production storage and offloading (FPSO) vessel. A riser 112 is shown extending from the rig, through the sea surface 102, sea water 104 and the sea bottom surface 106. At the sea bottom 106 a number of known well control devices are shown such as shear rams 116 and pipe rams 118. Also shown above the rams is riser disconnect 114.

Below flowhead 120 is an improved swivel 150, according to some embodiments. The improved swivel 150 may be used in a variety of subsea landing strings to enable relative rotational movement of systems located downhole and uphole of the improved swivel. In particular, swivel 150 allows rotation of the string 130 without rotating the flowhead 120, as illustrated by arrow 152. Swivel 150 also prevents any rig movement from transferring torque into the structure of riser 112 or landing string 130. Below swivel 150 is master valve 126. Below master valve 126, through the rig floor 110 and within riser 112 is test string 130. Test string 130 can include lubricator valve 132. Near the sea floor 106 is subsea test tree 136 and fluted hanger 138. String 140 is shown deployed in the subsea well penetrating subterranean rock formation 108. Not shown is one or more tools being deployed at the bottom of, or along, string 140. The tools would be configured according to the intended purpose of the operation.

Figure 2:
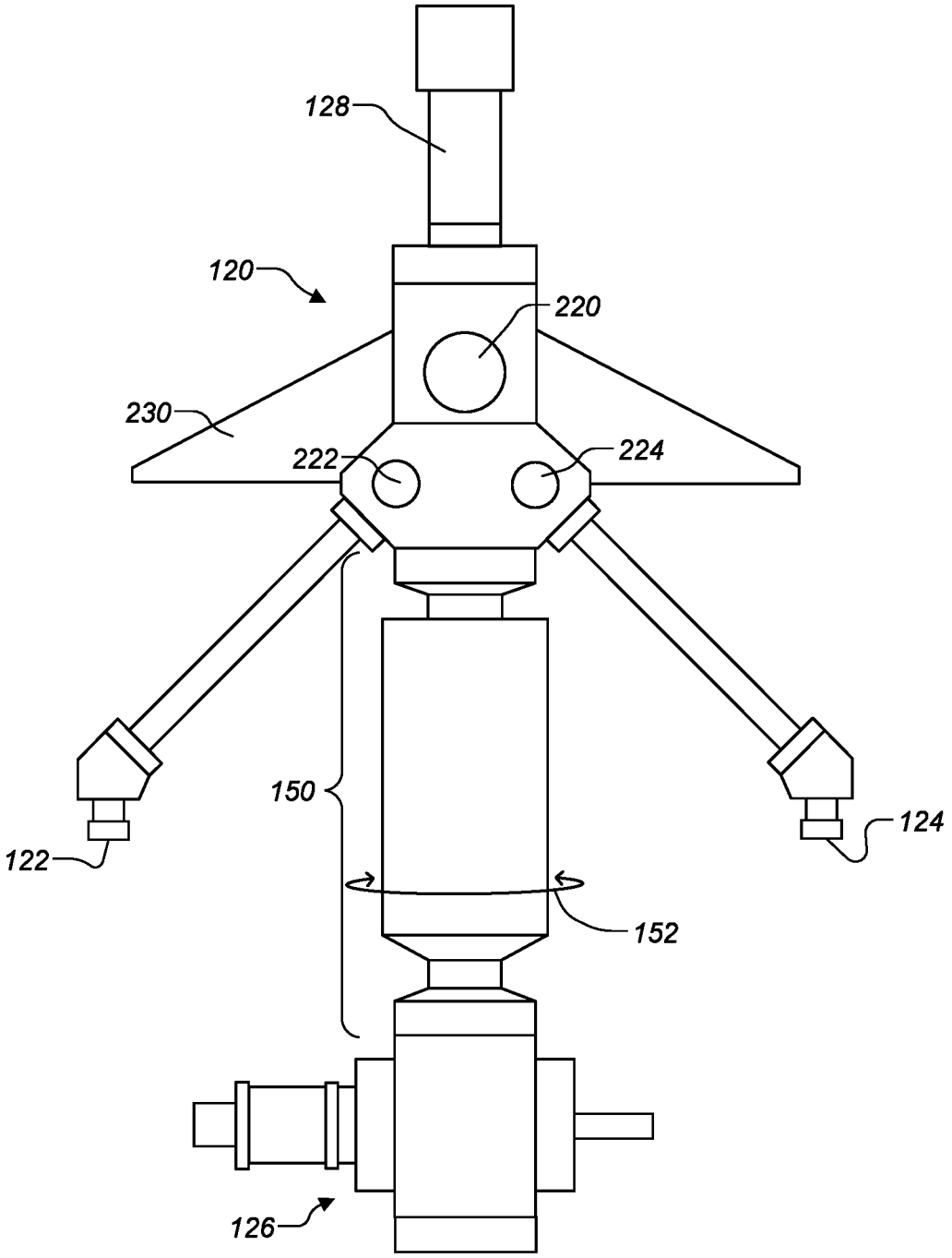
FIG. 2 is a schematic diagram illustrating further detail of a subsea landing string configuration in which an improved swivel can be utilized, according to some embodiments.

According to some embodiments, flowhead 120 includes several valves which are shown in greater detail in FIG. 2. Handling sub 128 is shown attached to the top of the flowhead valve block 120. Handling sub 128 is used to tension the flowhead 120 and the riser landing string 130. According to some embodiments, handling sub 128 can also be configured to provide an interface to the surface wireline or coiled tubing equipment.

FIG. 2 is a schematic diagram illustrating further detail of a subsea landing string configuration in which an improved swivel can be utilized, according to some embodiments. Flowhead 120 is shown to include three separate valves: swab valve 220, and wing valves 222 and 224. According to some embodiments, swab valve 220 and master valve 126 can be configured as either manually or hydraulically operated. Wing valve 222 can be configured as a manual or hydraulic-operated fail-safe actuator for kill line 122. Wing valve 124 can be configured as a hydraulic-operated fail-safe actuator for flow line 124. The wing valves 222 and 224 in flowhead 120 thus connect to the kill line 122 and flow line 124, respectively, for control of the flow of the wellbore fluids. According to some embodiments, valve actuators can be controlled from a console (not shown) located on the rig floor and can be linked to the emergency shutdown system for the flow wing valve 224. This configuration allows for remote shut-in of the well at the flowhead 120.

Figure 3:
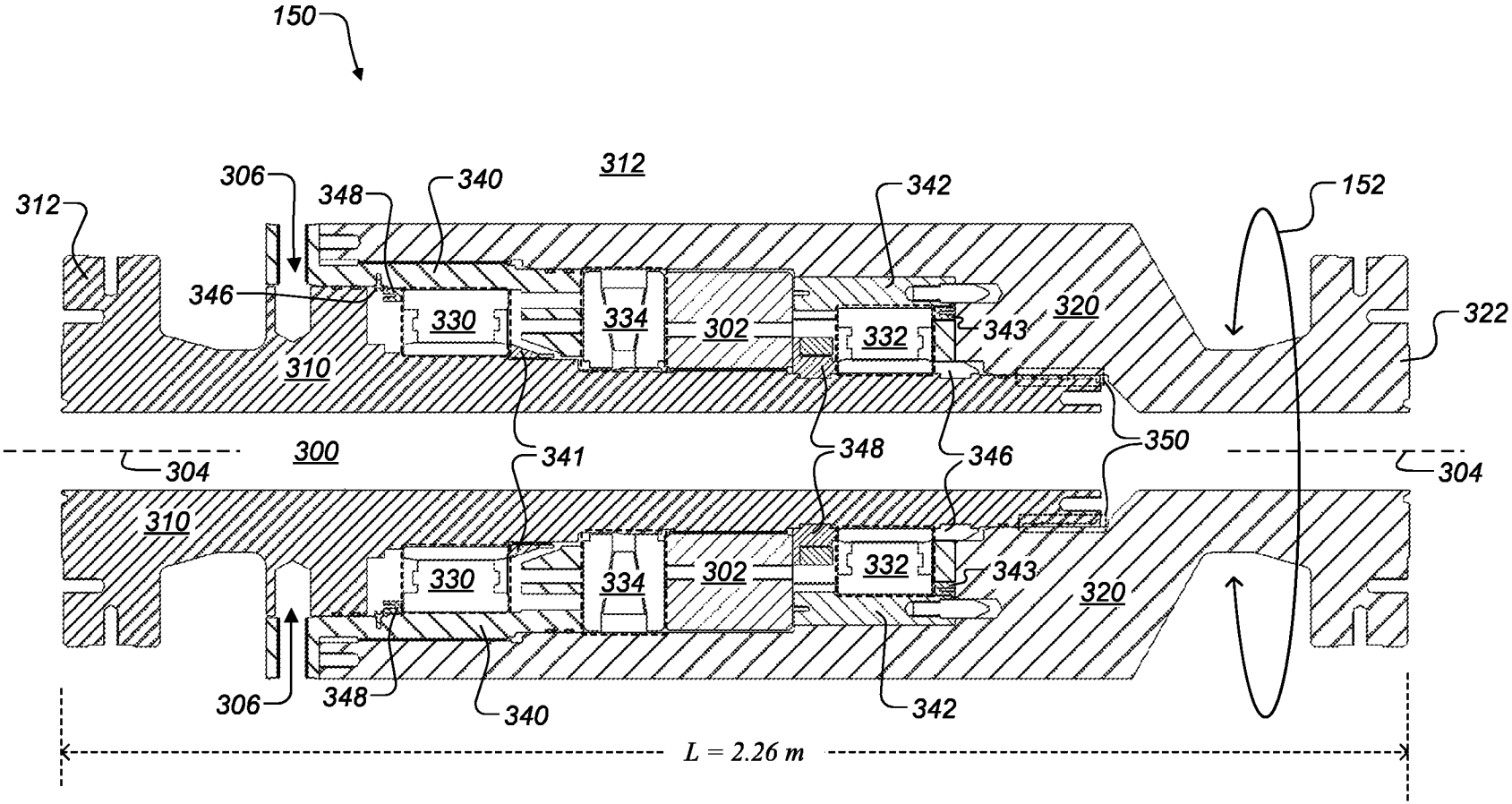
FIG. 3 is a schematic cross-sectional illustration of an example of an improved swivel, according to some embodiments.

FIG. 3 is a schematic cross-sectional illustration of an example of an improved swivel, according to some embodiments. The improved swivel 150 is axially compact by stacking bearings in close proximity to each other. According to some embodiments, the overall length L of swivel 150 is less than nine feet (2.74 m). According to some embodiments, the overall length L of swivel 150 is less than eight feet (2.44 m). According to some embodiments, the overall length L of swivel 150 is less than 7.5 feet (2.29 m). The swivel provides structures for retaining the bearing units so as to hold and protect the bearings against axial, rotational, and bending forces. According to some embodiments, the structures may be in the form of an upper bearing cartridge 340 and a lower bearing cartridge 342 for holding upper rotational bearing unit 330 and lower rotational bearing unit 332, which may include cylindrical roller bearings. The rotational bearing units 330 and 332 facilitate relative rotational motion about the central longitudinal axis 304 between the mandrel 310 and the housing 320. The upper and lower bearing cartridges 340 and 342 are used instead of conventional retaining rings/snap rings to provide the desired protection of the bearings against axial, rotational, and bending forces experienced by the swivel. For example, a plurality of rotational bearings and a thrust bearing may be positioned in bearing support structures in a manner which places such bearings in close proximity to each other, thus shortening the axial length of the swivel. According to some embodiments, the improved design allows for two or more of the following criteria to be simultaneously met: compact overall length, high operating pressures, high operating load, and large operational temperature range. According to some embodiments, a swivel is provided that can operate at working pressures above 15,000 psi (15 ksi). According to some embodiments, the swivel can operate at working pressures up to 16 ksi or 18 ksi. According to some embodiments the swivel can operate at working pressures up to 20 ksi. According to some embodiments, the swivel has an axial tensile load rating of at least 1,000,000 lbf @ 0 psi. According to some embodiments, the swivel has an axial tensile load rating of at least 1,200,000 lbf @ psi. According to some embodiments, the swivel has an axial tensile load rating of at least 1,400,000 lbf @ 0 psi. According to some embodiments, the swivel has an axial tensile load rating of at least 650,000 lbf @ 18 ksi. According to some embodiments, the swivel has an axial tensile load rating of at least 750,000 lbf @ 20 ksi. According to some embodiments, the swivel is rated for a bending moment of at least 400,000 ft-lbf @ 300 psi and 938,000 lbs. tension. According to some embodiments, the swivel is rated for a bending moment of at least 500,000 ft-lbf @ 300 psi and 938,000 lbs. tension. According to some embodiments, the swivel has a temperature rating of 40° F. to at least 200° F. According to some embodiments, the swivel has a temperature rating of at least 35° F. to 250° F. Furthermore, the improved design has advantages in ease of manufacturing. In particular, various elements and parts of the swivel are configured for straight forward assembly.

Referring to FIG. 3, the swivel 150 comprises a swivel mandrel 310 rotationally coupled with a swivel housing 320. Although the swivel is shown horizontally oriented in FIG. 3, swivel 150 is ordinarily mounted vertically, as shown in FIGS. 1 and 2, such that the mandrel 310 is above swivel housing 320. Swivel 150 includes a central bore 300 which in this example is nominally 5⅛ inches (actual inner diameter of bore 300 is 5.135 inches). The swivel 150 can be made having other dimensions of central bore diameter, outer diameter and overall length L. The outer diameter of the housing 320 is 30 inches. At the upper end of mandrel 310 is flange 312, which is used for an upper connection (e.g. to the flowhead 120 shown in FIGS. 1 and 2). The lower end of housing 320 is flange 322 which is used for a lower connection (e.g. to master valve 126 shown in FIGS. 1 and 2).

The swivel 150 may have a variety of other components, such as rotational bearings, thrust bearings, load nuts, bearing covers, and/or other components, to facilitate reliable relative rotation between the swivel mandrel 310 and the swivel housing 320 about central axis 304. In the example of FIG. 3, the relative rotational motion between mandrel 310 and housing 320 is facilitated by an upper rotational bearing 330 and a lower rotational bearing 332, both denoted using dashed outline. The axial load (i.e. in directions parallel to axis 304) of swivel 150 between the mandrel 310 and housing 320 is facilitated by thrust bearing 334, also denoted using dashed outline. Some or all of bearings units 330, 332 and 332 may include roller bearings, such as cylindrical roller bearings. The swivel 150 further comprises a rotating and pressure containing seal formed between the swivel mandrel 310 and swivel housing 320 via a redundant seal stack 350. The redundant seal stack 350 comprises redundant chevron seals (shown in greater detail in FIG. 5) arranged to provide and maintain sealing even during rotational cycling at high and low temperatures.

Note that both the upper bearing cartridge 340 and a lower bearing cartridge 342 are fixed to the housing 320 and thus rotate along with housing 320. The inner surfaces of rotational bearing units 330 and 332 are seated with the outer surface of mandrel 310, and the outer surfaces of rotational bearing units 330 and 332 are seated on the inner surfaces of cartridges 340 and 342 respectively. The upper rotational bearing unit 330 is prevented from moving longitudinally. In particular, upper bearing cartridge 340 and anti-backout retaining ring 348 are used for the outer side of bearing unit 330. The retaining ring 348 is held in place with cap screws 346. The inner side of upper bearing unit 330 is held in place by mandrel 310 and retaining ring 341. The outer side of lower bearing unit 332 is held longitudinally by cartridge 342 and retaining ring 343. The inner side of bearing unit 332 is held in place longitudinally by retaining rings 346 and 348.

Load nut 302 is fixed to mandrel 310, for example, by a threaded connection. The thrust bearing unit 334 thus is sandwiched between the lower surface of cartridge 340 (that is fixed to housing 320) and the upper surface of load nut 302 (that is fixed to mandrel 310). A rotational bore seal is also positioned between the swivel mandrel and the swivel housing. The rotational bore seal stack 350 provides the pressure containing dynamic seal which is able to maintain functionality during rotational cycling at high and low temperatures.

According to some embodiments, the swivel mandrel 310 and swivel housing 320 may initially be held together by, for example, bolts inserted into holes 306 and then released to enable the relative rotation with respect to each other. According to some embodiments, one or more of bearing units 330, 332 and 334 can be engineered cartridge-type bearing units, such as manufactured by Timken Company.

Figure 4A:
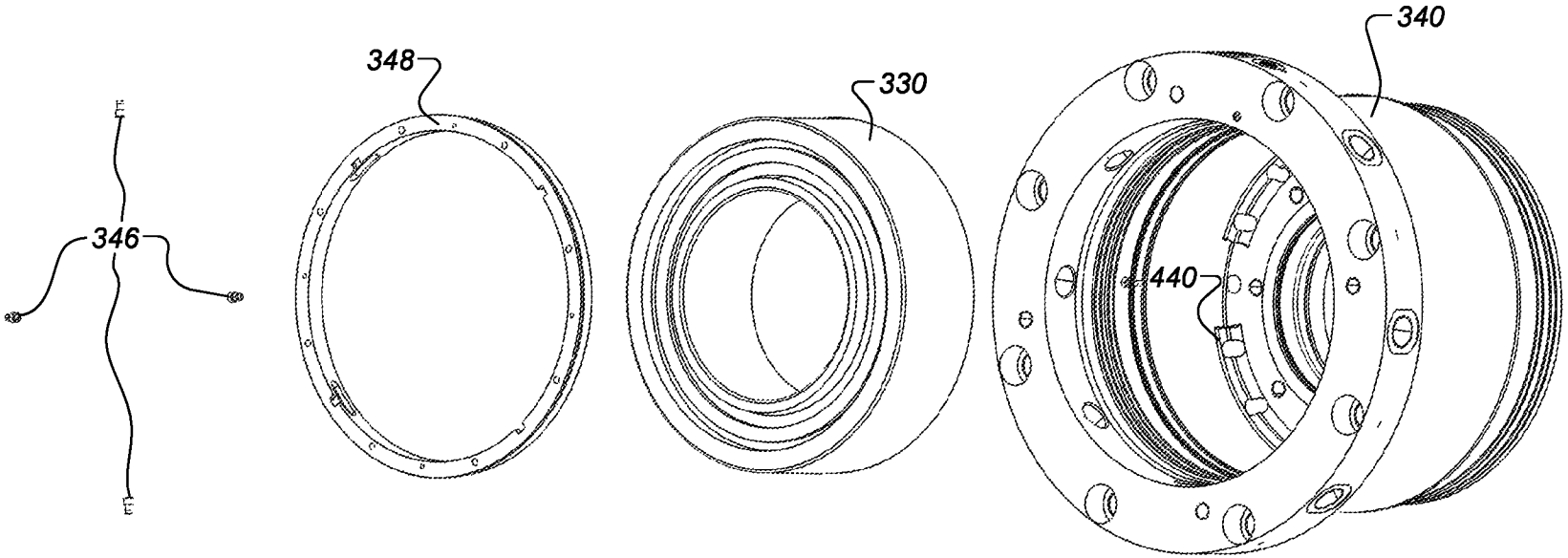
FIGS. 4A and 4B are exploded perspective view diagrams illustrating further detail of some of the upper and lower rotational bearing components, respectively, according to some embodiments.
Figure 4B:
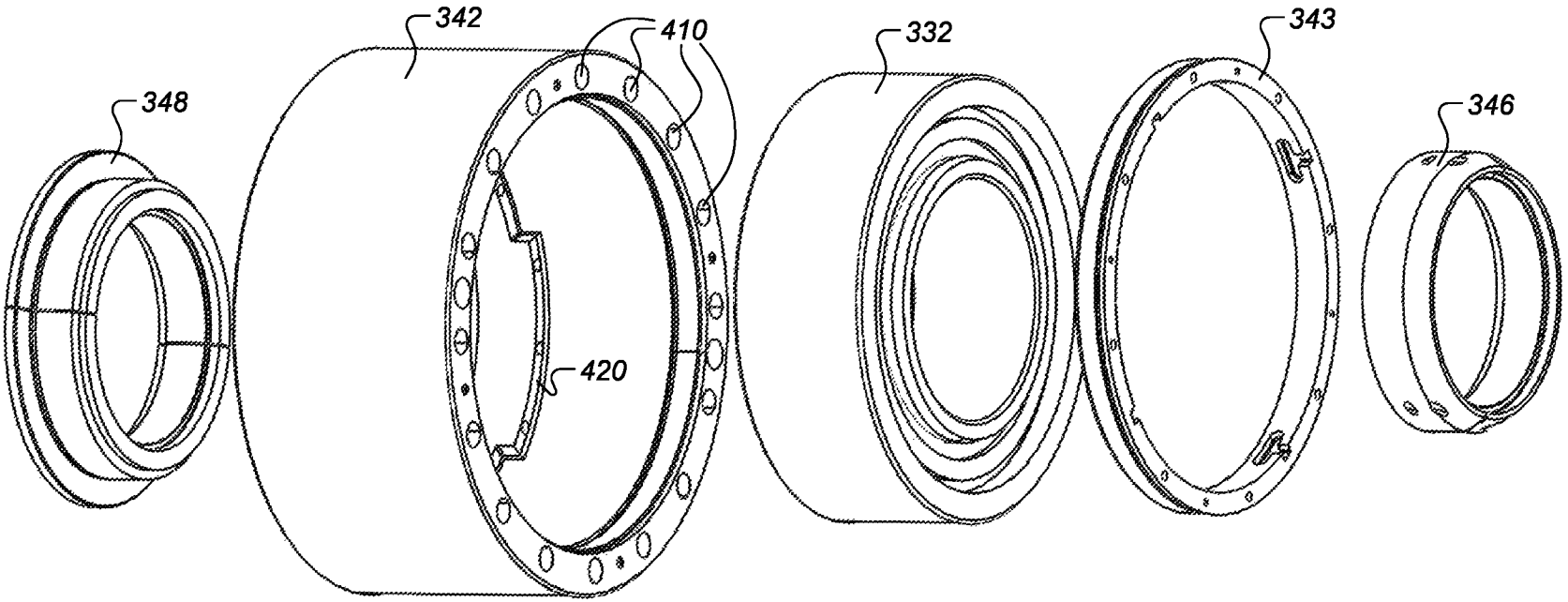

FIGS. 4A and 4B are exploded perspective view diagrams illustrating further detail of some of the upper and lower rotational bearing components, respectively, according to some embodiments. As described, supra, the rotational bearings may be in the form of upper cylindrical rotational bearing unit 330 and lower cylindrical rotational bearing unit 332. The upper bearing unit 330 is protected against axial, rotational, and bending forces by an upper bearing cartridge 340, as further illustrated in FIG. 4A. The upper bearing unit 330 is secured on its outer side by upper bearing cartridge 340 (including ridge member 440) and anti-backout ring 348. According to some embodiments, the anti-backout ring 348 is held in place with a plurality of screws, e.g. four cap screws 346.

Referring to FIG. 4B, the outer side of lower bearing unit 332 is secured on its outer side by the inner surface of cartridge 342 (including ridge member 420) and retaining ring 343 (shown in FIG. 3). According to some embodiments, a lower bearing cartridge may be secured to the housing 320 via a number of threaded fasteners (not shown) positioned through a plurality of openings 410. According to an example, 16 fasteners (or other suitable number of fasteners) may be positioned to extend axially through the lower bearing cartridge 342 so as to secure the lower bearing cartridge in place and to support the lower rotational bearing unit 332. It should be noted the upper bearing cartridge 340 and the lower bearing cartridge 342 can enable an improved swivel 150 to be more reliable than conventional swivels. The bearing cartridges 340 and 342 allow the swivel 150 to hold more axial load than conventional swivels, and the bearing cartridges can be scaled to various types and sizes of swivels.

Figure 5:
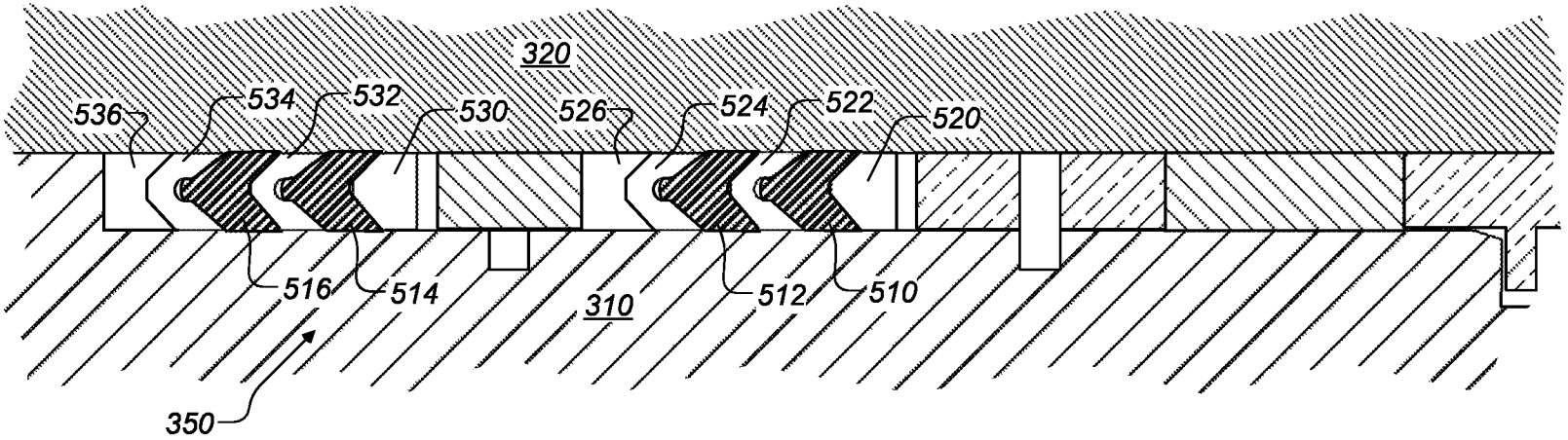
FIG. 5 is a cross section view illustrating further detail of dynamic sealing mechanisms using in an improved swivel, according to some embodiments.

FIG. 5 is a cross section view illustrating further detail of dynamic sealing mechanisms using in an improved swivel, according to some embodiments. Visible is a detailed view of a cross section of the redundant seal stack 350. As can be seen, the stack 350 is made up of a primary seal 500 and the secondary seal 502. In the view shown in FIG. 5, downhole is to the right side (as in FIG. 3). The primary and secondary seals 500 and 502, as well as the other elements longitudinally aligned with those seals are mounted fixed to the outer portion (upper in FIG. 5) of mandrel 310. Therefore, the relative motion and the dynamic sealing will be formed between the outer portion (upper in FIG. 5) of the seals 500 and 502 and the inner surface (lower in FIG. 5) of housing 320. According to some embodiments, rotating and pressure containing seals 500 and 502 may each comprise a dual, unidirectional chevron stack separated by a spacer ring, e.g. a plastic spacer ring. In particular, the primary seal 500 includes two elastomeric sealing elements 510 and 512 having chevron-shaped cross sections separated by a plastic spacer ring 522. Seal 500 also includes further plastic spacers below (520) and above 524 and 526 of the sealing elements 510 and 512. Similarly, the secondary seal 502 includes two elastomeric sealing elements 514 and 516 having chevron-shaped cross sections separated by a plastic spacer ring 532. Seal 502 also includes further plastic spacers below (530) and above 534 and 536 of the sealing elements 514 and 516. This a dual chevron stack provides a primary and a secondary rotational and pressure containing seal for the swivel. According to some embodiments, additional retainers, spacers, and/or retention mechanisms may be used to secure the pressure containing and rotating seals 500 and 502 at a desired location between the swivel mandrel and the swivel housing. Note that in the illustrated example, the chevron seals 510, 512, 514 and 516 of both the primary seal 500 and the secondary seal 502 are unidirectional, although various arrangements and orientations of chevron seals may be used to accommodate parameters of a given operation.

The pressure containing and rotating seal stack 350 provides reliable pressure containment during relative rotation of the swivel components and may be used in, for example, an in-riser subsea landing string. The pressure containing and rotating seal 350 enables simple, dependable operation and also may be used to retrofit existing swivels. In other words, the pressure containing and rotating seal 350 may be sized and configured to fit within existing seal cavities. In some embodiments, the seal cavity may be modified to accommodate the pressure containing and rotating seal with increased length or size. For example, the seal cavity length of the swivel mandrel could be modified to accommodate the desired pressure containing and rotating seal. The construction of the pressure containing and rotating seal 350 also enables use of the swivel in subsea 20K (20,000 psi) system applications.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A swivel configured for mounting along a tool string being deployed in an offshore environment, the swivel comprising:

a swivel mandrel including a first mechanical connector and defining at least a portion of a central longitudinal bore through which pressurized well fluids are configured to pass;

a swivel housing at least partially surrounding the swivel mandrel and including a second mechanical connector;

first and second rotation bearing units together allowing for relative rotation about a central longitudinal axis and between the swivel mandrel and the swivel housing, thereby providing for relative rotation between one or more structures mounted to the first mechanical connector and one or more structures mounted to the second mechanical connector;

first and second rotation bearing cartridges configured to secure and retain the first and second rotation bearing units, respectively, wherein the first and second rotation bearing cartridges are separate from one another, and each of the first and second rotation bearing cartridges is removably coupled to the swivel housing;

a thrust bearing unit configured to allow for relative rotation between the swivel mandrel and the swivel housing, the thrust bearing unit primarily supporting axial loads between the swivel mandrel and the swivel housing in directions parallel to the longitudinal axis; and a rotating and pressure containing dynamic sealing system, the sealing system configured to contain the pressurized well fluids flowing through the central bore.

2. The swivel according to claim 1, wherein the tool string includes a subsea landing string configured for deployment through a subsea riser structure.

3. The swivel according to claim 1, wherein the swivel is configured to be vertically mounted with the first mechanical connector being made to a flowhead above the swivel and with the second mechanical connector being made to a master valve below the swivel.

4. The swivel according to claim 1, wherein the first and second rotation bearing units each include a plurality of cylindrical rolling bearing elements.

5. The swivel according to claim 1, wherein an overall length of the swivel measured between the first and second mechanical connectors is less than 10 feet, the swivel mandrel extends axially to a first axial end of the swivel having the first mechanical connector, the swivel housing extends axially to a second axial end of the swivel having the second mechanical connector, and the first and second axial ends are opposite from one another about the overall length of the swivel, wherein the first and second rotation bearing units, the first and second rotation bearing cartridges, the thrust bearing unit, and the dynamic sealing system are disposed radially between the swivel mandrel and the swivel housing.

6. The swivel according to claim 1, wherein the axial loads are up to at least 1,000,000 pounds while the central bore is not pressurized.

7. The swivel according to claim 1, wherein the dynamic sealing system is configured to at least one of: contain well fluids as low as 35° F. and as high as 250° F. and contain pressurized well fluids up to pressures of at least 15,000 psi.

8. The swivel according to claim 1, wherein each of the first and second rotation bearing cartridges comprises inner surfaces, which are configured to securely engage outer surfaces of the first and second rotation bearing units, respectively, each of the first and second rotation bearing cartridges is removably mounted in a fixed relationship with respect to the swivel housing, and each of the first and second rotation bearing units has inner surfaces configured to engage outer surfaces on the swivel mandrel.

9. The swivel according to claim 1, wherein the thrust bearing unit is disposed axially between the first and second rotation bearing units.

10. The swivel according to claim 1, wherein the dynamic sealing system comprises a primary seal and a secondary seal, each of the primary seal and the secondary seal having a plurality of elastomeric sealing elements with chevron-shaped cross-sections.

11. The swivel according to claim 10, wherein the first rotation bearing unit, the thrust bearing unit, and the second rotation bearing unit are arranged in a sequence over an axial distance, wherein the dynamic sealing system has the primary seal and the secondary seal axially offset away from the axial distance.

12. The swivel according to claim 1, wherein the first and second mechanical connectors are flanges configured to each accept a plurality of threaded fasteners.

13. A swivel configured for mounting along a tool string being deployed in an offshore environment, the swivel comprising:

a swivel mandrel including a first mechanical connector and defining at least a portion of a central longitudinal bore through which pressurized well fluids are configured to pass;

a swivel housing at least partially surrounding the swivel mandrel and including a second mechanical connector;

first and second rotation bearing units together allowing for relative rotation about a central longitudinal axis and between the swivel mandrel and the swivel housing, thereby providing for relative rotation between one or more structures mounted to the first mechanical connector and one or more structures mounted to the second mechanical connector;

a thrust bearing unit configured to allow for relative rotation between the swivel mandrel and the swivel housing, the thrust bearing unit primarily supporting axial loads between the swivel mandrel and the swivel housing in directions parallel to the longitudinal axis, wherein the thrust bearing unit is disposed axially between the first and second rotation bearing units; and a rotating and pressure containing dynamic sealing system, the sealing system configured to contain pressurized well fluids flowing through the central bore, the sealing system comprising a primary seal and a secondary seal, each of the primary seal and the secondary seal having a plurality of elastomeric sealing elements with chevron-shaped cross-sections.

14. The swivel according to claim 13, wherein the tool string includes a subsea landing string configured for deployment through a subsea riser structure, or the swivel is configured to be vertically mounted with the first mechanical connector being made to a flowhead above the swivel and with the second mechanical connector being made to a master valve below the swivel, or a combination thereof.

15. The swivel according to claim 13, wherein the first rotation bearing unit, the thrust bearing unit, and the second rotation bearing unit are arranged in a sequence over an axial distance, wherein the dynamic sealing system has the primary seal and the secondary seal axially offset away from the axial distance.

16. The swivel according to claim 13, wherein the dynamic sealing system is configured to at least one of: contain well fluids as low as 35° F. and as high as 250° F. and contain pressurized well fluids up to pressures of at least 15,000 psi.

17. The swivel according to claim 13, further comprising first and second rotation bearing cartridges configured to secure and retain the first and second rotation bearing units, respectively, wherein the first and second rotation bearing cartridges are separate from one another, and each of the first and second rotation bearing cartridges is removably coupled to the swivel housing.

18. The swivel according to claim 17, wherein the each of the first and second rotation bearing cartridges comprises inner surfaces, which are configured to securely engage outer surfaces of the first and second rotation bearing units, respectively, each of the first and second rotation bearing cartridges is removably mounted in a fixed relationship with respect to the swivel housing, and each of the first and second rotation bearing units has inner surfaces configured to engage outer surfaces on the swivel mandrel.

19. The swivel according to claim 13, wherein the first and second rotation bearing units each include a plurality of cylindrical rolling bearing elements.

20. The swivel according to claim 13, wherein an overall length of the swivel measured between the first and second mechanical connectors is less than 8 feet or the axial loads are up to at least 1,200,000 pounds while the central bore is not pressurized.

* * * * *